United States Patent [19]

Munroe et al.

[11] 4,349,313

[45] Sep. 14, 1982

[54] ABRADABLE RUB STRIP

[75] Inventors: Alan D. Munroe, Glastonbury; Peter E. Voyer, Tolland, both of Conn.

[73] Assignee: United Technologies Corporation, Hartford, Conn.

[21] Appl. No.: 106,582

[22] Filed: Dec. 26, 1979

[51] Int. Cl.[3] ..... F01D 11/08

[52] U.S. Cl. ..... 415/174; 415/196; 415/200

[58] Field of Search ..... 415/174, 196, 200; 277/96, 96.1, 96.2, 95, 235 R

[56] References Cited

U.S. PATENT DOCUMENTS

| | | | |
|---|---|---|---|
| 192,285 | 6/1877 | Rohrbacher et al. | 415/197 |
| 201,511 | 3/1878 | Eyster | 415/197 |
| 1,380,798 | 6/1921 | Hansen et al. | 415/197 |
| 1,967,182 | 7/1934 | Allen | 415/197 |
| 2,840,343 | 6/1958 | Brandt et al. | 415/174 |
| 2,879,936 | 3/1959 | Faught | 415/197 |
| 3,412,977 | 11/1968 | Moyer et al. | 415/174 |
| 3,547,455 | 12/1970 | Daunt | 415/174 |
| 3,575,427 | 4/1971 | Lapac et al. | 277/96 |
| 3,732,028 | 5/1973 | Heynemanns et al. | 415/197 |
| 3,756,741 | 9/1973 | Woell | 415/174 |
| 3,843,278 | 10/1974 | Torell | 415/174 |
| 3,880,550 | 4/1975 | Corey et al. | 415/174 |
| 3,887,299 | 6/1975 | Profant | 415/174 |
| 4,039,296 | 8/1977 | Levinstein | 277/96 |
| 4,120,605 | 10/1978 | Hurst | 415/174 |
| 4,234,291 | 11/1980 | Hurst et al. | 415/174 |

FOREIGN PATENT DOCUMENTS

| | | | |
|---|---|---|---|
| 879740 | 10/1961 | United Kingdom | 415/174 |

*Primary Examiner*—Robert E. Garrett
*Attorney, Agent, or Firm*—Gene D. Fleischhauer

[57] ABSTRACT

An abradable rub strip for use in the compression section of a gas turbine engine is disclosed. Various construction details are developed for limiting penetration of the abradable rub strip by an array of rotor blades. A ring formed of metallic material is embedded in the abradable rub strip.

10 Claims, 3 Drawing Figures

ABRADABLE RUB STRIP

BACKGROUND OF THE INVENTION

1. Field of the Invention

This invention relates to gas turbine engines, and more particularly to an abradable rub strip circumscribing an array of rotor blades in the compression section of such an engine.

2. Description of the Prior Art

A gas turbine engine has a compression section, a combustion section and a turbine section. The compression section has a rotor assembly. In the compression section, an engine case circumscribes the rotor assembly. The rotor assembly includes an array of rotor blades extending outwardly across the working medium flowpath into proximity with the outer case. An annular flowpath for working medium gases extends axially through the compression section between the rotor assembly and the engine case.

In modern engines, an abradable rub strip circumscribes the array of rotor blades and is attached to the engine case. The rub strip is formed of an easily abradable material such that, as the rotor blades move outwardly in response to operative conditions, a groove is worn in the abradable material. Even when all components reach steady-state positions, the relative position of the rotor blades and the abradable rub strip decrease leakage as compared with constructions that do not have abradable rub strips. Accordingly, use of an abradable rub strip improves compressor performance over constructions not having the strips. One construction having an abradable rub strip is illustrated in U.S. Pat. No. 3,843,278 to Torell entitled, "Abradable Seal Construction".

It is desirable in modern engines to make the engine cases and the rotor blades of a lightweight material having a density less than 0.2 pounds per cubic inch. An example of such a metal alloy is titanium. The use of titanium is of some concern because a rubbing contact between a titanium blade and a titanium case may result in ignition of the titanium case and subsequent burn through of the case. Because of the close proximity of the rotor blades to the outer case, the rotor blades may cut through the rub strip and rub against the outer case during abnormal operating conditions. Such a rubbing contact might unavoidably occur when the rotor assembly rotates eccentrically about its axis during a bearing failure or in response to foreign object damage to the blades.

In response to the concerns expressed above, scientists and engineers seek to develop an effective abradable rub strip which limits the depth of penetration of the abradable rub strip by the rotor blades when a rotor bearing fails or when there is foreign object damage to the rotor assembly.

SUMMARY OF THE INVENTION

A primary object of the present invention is to block the leakage of working medium gases in an annular gap between an array of rotor blades and an outer case. An abradable rub strip having both an ability to accept penetration by the blades and an ability to limit the depth of that penetration is sought. Furthermore, the rub strip must maintain its structural integrity and be supported from the outer case even upon severe contact between the blades and the rub strip.

According to the present invention, a metallic ring is embedded within a rotor blade rub strip of viscoelastic material to limit the depth of penetration of the rub strip by the rotor blade.

In accordance with the present invention, one embodiment of the rotor blade rub strip is fabricated by forming a circumferentially extending groove about the interior of the engine, filling the groove with a viscoelastic material, embedding therein a ring formed of a metallic material by sliding the ring circumferentially into the groove, and curing the viscoelastic material.

A primary feature of the present invention is the abradable rub strip. Another feature is the metallic ring embedded in the rub strip. The rub strip is formed of a viscoelastic material. Another feature is the circumferentially extending groove in the outer case. In one embodiment, the case has an upstream flange extending laterally over the groove and a downstream flange extending laterally over the groove to mechanically trap the ring.

A principal advantage of the present invention is the gain in engine efficiency which results from blocking the leakage of working medium gases between the array of rotor blades and the outer case. Destructive contact between the outer case and the rotor blades is avoided by use of the abradable rub strip which limits the depth of penetration of the rotor blades. The ability of the combination of the ring and the viscoelastic material to withstand high energy contact results from the ability of the ring to resist stress and the flexibility provided by the viscoelastic material. In one embodiment, the ring is trapped mechanically by the flanges and trapped viscoelastically by the viscoelastic material.

The foregoing and other objects, features and advantages of the present invention will become more apparent in the light of the following detailed description of preferred embodiments thereof as discussed and illustrated in the accompanying drawing.

DETAILED DESCRIPTION

Figure 1:
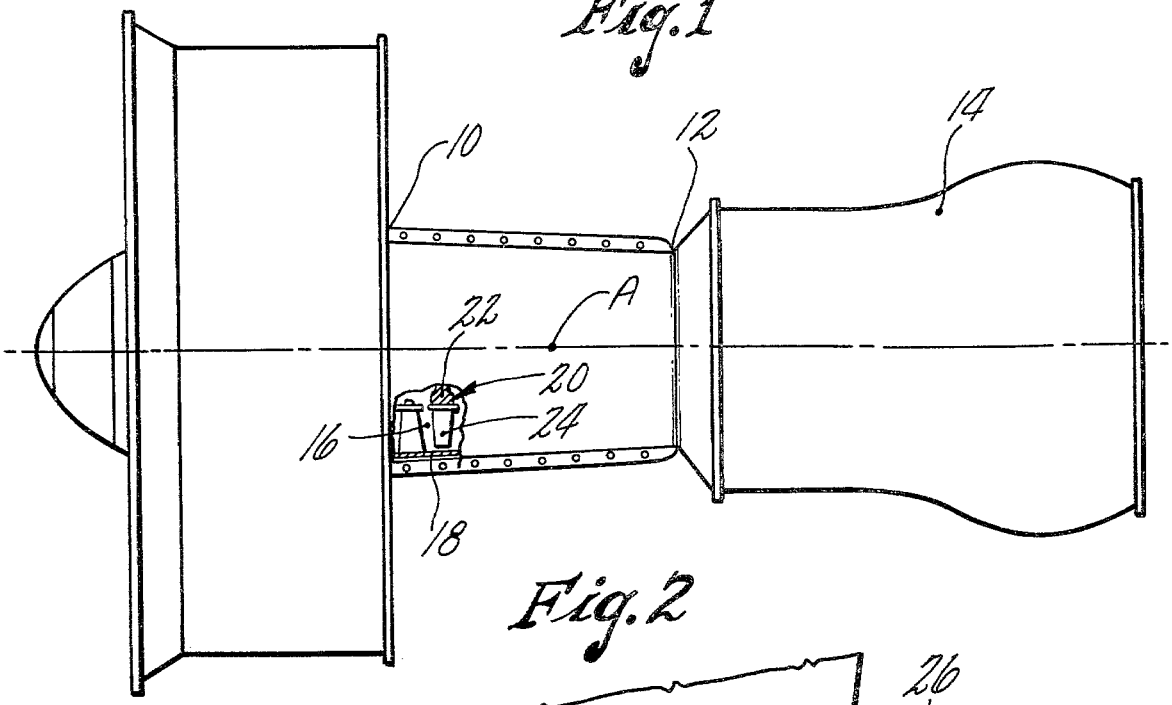
FIG. 1 is a simplified plan view of a turbofan engine with a portion of the outer case broken away to reveal a rotor assembly and an engine case.

A gas turbine engine embodiment of the invention is illustrated in FIG. 1. The principal sections of the engine include a compression section 10, a combustion section 12 and a turbine section 14. An annular flowpath 16 for working medium gases extends axially through the engine. An engine outer case 18 circumscribes the working medium flowpath. A rotor assembly 20 is disposed inwardly of the outer case and has an axis of rotation A. In the compression section, the rotor assembly includes a rotor disk 22 and an array of rotor blades, as represented by the single rotor blade 24. The array of rotor blades extends outwardly from the disk across the working medium flowpath into proximity with the outer case.

Figure 2:
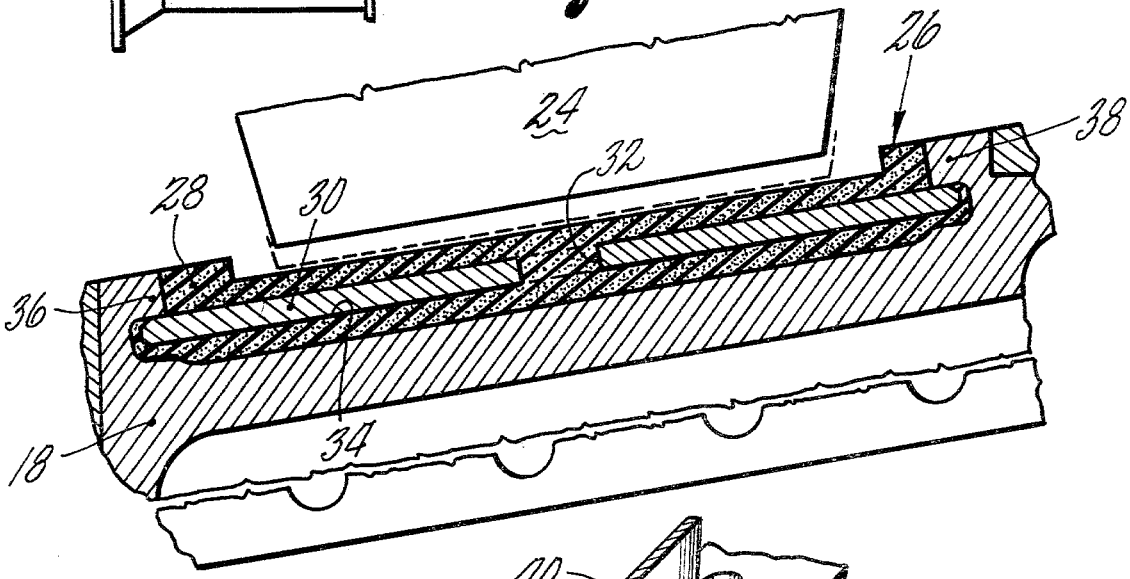
FIG. 2 is a cross section view of a portion of the engine case, the rotor assembly and an abradable rub strip.

As shown in FIG. 2, an abradable rub strip 26 circumscribes the array of rotor blades 24 and is attached to the outer case 18. The rub strip is formed of a viscoelastic material 28. A ring 30 formed of metallic material is embedded in the viscoelastic material. The ring is coextensive with the viscoelastic material in the circumferential direction. The ring has a plurality of holes 32 extending radially therethrough. As will be realized, the ring may be formed without such holes.

A groove 34 extending circumferentially about the interior of the case 18 adapts the case to receive the abradable rub strip. The case has an upstream flange 36 extending laterally over the groove and a downstream flange 38 extending laterally over the groove. The flanges in combination mechanically trap the ring 30 in the groove. As will be realized the engine case may be formed without flanges, or may be formed with flanges that are detachable.

The case 18 is formed of two axially extending halves. The rub strip 26 has two segments, each segment extending approximately one hundred and eighty degrees (180°) and each engaging a respective half of the axially split case. As will be realized, the rub strip may be used in cases which are circumferentially continuous. For both types of case constructions, the rub strip may be made in one piece or made in segments.

Figure 3:
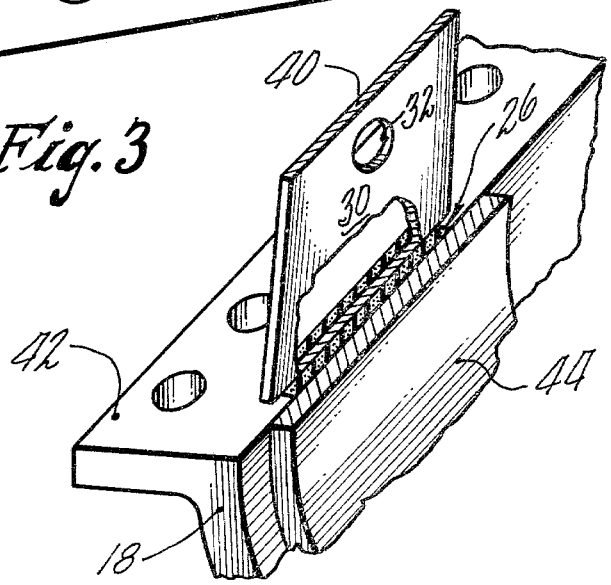
FIG. 3 is a partial perspective view of the engine case and a partially assembled abradable rub strip during assembly.

FIG. 3 is a partial perspective view of one half of the engine case 18 and a partially installed abradable rub strip 26. The ring 30 has an end 40. The case has a flange surface 42. A mold 44 is pressed against the interior of the case during installation of the rub strip. With the mold in place, the circumferentially extending groove is filled with viscoelastic material. The ring of flexible metallic material is tangentially inserted in the groove outwardly of the flanges 36, 38 and slid circumferentially into position such that the end 40 is even with the surface 42. The excess viscoelastic material displaced by the insertion of the ring is removed. The viscoelastic material is cured. The mold is removed. As will be realized, further curing may take place.

One satisfactory viscoelastic material for the abradable rub strip 26 is a silicone rubber compound containing hollow glass microspheres and requiring a catalyst for polymerization, such as DC-93-118 compound distributed by the Dow Corning Corporation, Midland, Mich. The glass microspheres are of 13–17 weight percent. This particular viscoelastic material is deaerated at a reduced pressure of twenty-five to fifty millimeters of mercury absolute pressure. After insertion of the ring, the viscoelastic material is cured in the mold for one hour at 300° F. and post cured out of the mold at 400° F. for one hour.

The operative environment of the ring is anticipated to have temperatures of approximately five hundred twenty-five degrees Fahrenheit (525° F.) at pressures of approximately one hundred twenty pounds per square inch absolute (120 psia). The ring of metallic material is selected from families of metallic materials which are chemically inert with respect to sustained combustion in the operative environment of the ring and, thus, do not support combustion. Lightweight structures are desirable and accordingly the density of the material should not exceed four tenths of a pound per cubic inch (0.4 $lb/in^3$) and the modulus of elasticity in tension should be equal to or greater than twenty million pounds per square inch ($2.0\times10^7$ $lb/in^2$). Materials selected from the group of metal alloys consisting of nickel base alloys, iron base alloys, and cobalt base alloys and combinations thereof are thought to be satisfactory. One material known to be effective is the iron base alloy AMS (Aerospace Material Specification) 5504 having a density of twenty-eight hundreths of a pound per cubic inch (0.28 $lb/in^3$) and a modulus of elasticity in tension of twenty-nine million pounds per square inch ($2.9\times10^7$ $lb/in^2$).

During operation of the gas turbine engine, the working medium gases are compressed by operation of the rotor assembly 20. As the gases are compressed, the temperature and the pressure of the gases increase. Components of the compression section in intimate contact with the working medium gases experience a temperature rise that is greater than components such as the outer case 18 which are not in such close proximity to the working medium gases. Resulting differences in thermal growth cause the rotor blades to move outwardly toward the rotor case. In addition, operational forces cause the rotor blades to move outwardly. As the rotor blades move outwardly, the blades wear away a portion of the abradable rub strip 26 and reach a moved position as indicated by the broken lines in FIG. 2. As the outer case reaches steady-state position, the outer case expands away from the rotor blades. Thus the rotor blade is still in close proximity to the abradable rub strip by reason of the ability of the rub strip to accept penetration by the rotor blade.

The viscoelastic material adheres to the outer case and to the ring embedded in the viscoelastic material. As will be realized, a primer may be used to increase the adhesive bond between the viscoelastic material and the ring and between the viscoelastic material and the case. The viscoelastic material has the ability to sustain a small amount of movement circumferentially without destroying the bond between the viscoelastic material and the engine case or between the viscoelastic material and the ring. This ability enables the combination of the ring and the viscoelastic material to resist the large shearing force developed between the ring and the viscoelastic material upon contact between a high energy rotor blade and the ring. Accordingly, the ring remains in place although some small temporary movement of the ring away from the rotor blades may take place during contact between the blade and the ring. A small permanent deformation of the ring may take place after repeated contact between the ring and the rotor blades.

As stated earlier, the ring is selected from a family of metallic materials which is chemically inert with respect to sustained combustion in the operative environment of the ring. Thus, the ring does not support combustion. Combustion of the ring does not take place even though a large amount of heat may be generated by the rubbing contact between the blades of the rotor assembly during a bearing failure or by the rubbing contact of a rotor blade trapped between the array of rotor blades and the ring. Such a failure will be quickly manifested in the engine operating parameters and the engine will be shut down. In the critical time before shutdown, the ring prevents the disastrous contact between the array of rotor blades and the outer case.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. In a gas turbine engine of the type having an engine case spaced from and circumscribing an array of rotor blades, the improvement which comprises:

an abradable rub strip which is attached to the engine case and which circumscribes the array of rotor blades, the rub strip being formed of a viscoelastic material and having embedded therein a ring formed of metallic material;

wherein the ring limits the depth of penetration of the rub strip by the rotor blade upon contact between the rotor blade and the rub strip and wherein the ring is spaced from the rotor blades during normal operation of the rotor blades to prevent contact between the rotor blades and the rub strip.

2. The invention according to claim 1 wherein the metallic material is chemically inert with respect to sustained combustion in the operative environment of the ring.

3. The invention according to claim 2 wherein said metallic material has a density less than four tenths of a pound per cubic inch (0.4 $lb/in^3$) and a modulus of elasticity in tension equal to or greater than twenty million pounds per square inch ($2.0\times10^7$ $lb/in^2$).

4. The invention according to claim 1 wherein the ring is formed of a metallic material selected from the group of metal alloys consisting of nickel base alloys, iron base alloys, cobalt base alloys and combinations thereof.

5. The invention according to claim 2 wherein the rub strip is segmented.

6. The invention according to claim 2 wherein the case has a means for mechanically trapping the ring and wherein the elastomeric material extends between the ring and the means for mechanically trapping the ring.

7. The invention according to claim 4 wherein the case has a means for mechanically trapping the ring and wherein the elastomeric material extends between the ring and the means for mechanically trapping the ring.

8. The invention according to claims 1, 2, 4, 5, 6 or 7 wherein the ring is fully encapsulated in the rub strip.

9. A method for limiting the depth of penetration of an abradable rub strip by an array of rotor blades and for elastically supporting the rub strip from an engine case spaced from and circumscribing the array of rotor blades, comprising the steps of:

disposing a viscoelastic material about the interior of the engine case;

adhering the viscoelastic material to the outer case;

embedding a circumferentially extending ring formed of a metallic material in the viscoelastic material at a depth which spaces the ring from the rotor blades during normal operation of the rotor blades to prevent contact between the rotor blades and the rub strip.

10. A method for forming an abradable rub strip in an engine case including the steps of:

forming a circumferentially extending groove about the interior of an engine case;

applying a mold to the engine case having a face which closes the groove and which is contoured geometrically to match the contour of the case in the region of the mold;

filling the groove with a viscoelastic material;

sliding circumferentially into the groove a ring formed of a metallic material;

curing the viscoelastic material.

* * * * *